US008888992B2

(12) United States Patent
Hedrick et al.

(10) Patent No.: US 8,888,992 B2
(45) Date of Patent: Nov. 18, 2014

(54) PROCESS AND APPARATUS FOR IMPROVING FLOW PROPERTIES OF CRUDE PETROLEUM

(75) Inventors: Brian W. Hedrick, Rolling Meadows, IL (US); James F. McGehee, Mount Prospect, IL (US); Selman Z. Erisken, Wilmette, IL (US); Jibreel A. Qafisheh, Prospect Heights, IL (US)

(73) Assignee: UOP LLC, Des Plaines, IL (US)

( * ) Notice: Subject to any disclaimer, the term of this patent is extended or adjusted under 35 U.S.C. 154(b) by 1783 days.

(21) Appl. No.: 11/200,285

(22) Filed: Aug. 9, 2005

(65) Prior Publication Data

US 2007/0034550 A1 Feb. 15, 2007

(51) Int. Cl.
*C10G 11/18* (2006.01)
*C10G 11/00* (2006.01)

(52) U.S. Cl.
CPC ..... *C10G 11/00* (2013.01); *C10G 2300/4062* (2013.01); *C10G 2300/302* (2013.01); *C10G 2300/308* (2013.01); *C10G 2300/304* (2013.01); *C10G 2400/28* (2013.01); *C10G 2400/02* (2013.01); *C10G 2300/44* (2013.01)
USPC ..... 208/92; 208/113

(58) Field of Classification Search
USPC ..... 208/106, 113, 92
See application file for complete search history.

(56) References Cited

U.S. PATENT DOCUMENTS

| | | | | | |
|---|---|---|---|---|---|
| 2,406,640 | A | * | 8/1946 | Siecke | 208/165 |
| 2,719,105 | A | * | 9/1955 | Peterson et al. | 208/93 |
| 3,057,704 | A | | 10/1962 | Franz et al. | 44/70 |
| 3,247,129 | A | | 4/1966 | Roelofsen et al. | 252/417 |
| 3,401,124 | A | | 9/1968 | Goulden | 252/417 |
| 3,532,620 | A | | 10/1970 | Asmus et al. | 208/113 |
| 3,591,485 | A | | 7/1971 | Mason, Jr. | 208/78 |
| 3,689,402 | A | | 9/1972 | Youngblood | 208/93 |
| 3,702,308 | A | | 11/1972 | Bauer et al. | 252/417 |
| 3,767,564 | A | | 10/1973 | Youngblood et al. | 208/92 |
| 3,856,659 | A | * | 12/1974 | Owen | 208/80 |
| 3,875,046 | A | * | 4/1975 | Rosenbloom | 208/391 |
| 3,900,391 | A | | 8/1975 | Merrill, Jr. et al. | 208/370 |
| 4,062,761 | A | * | 12/1977 | Luckenbach | 208/164 |
| 4,192,734 | A | * | 3/1980 | Pavlica et al. | 208/93 |
| 4,299,687 | A | * | 11/1981 | Myers et al. | 208/113 |
| 4,332,670 | A | | 6/1982 | Antal | 208/68 |
| 4,509,326 | A | | 4/1985 | Jorgensen | 60/39.182 |
| 4,510,043 | A | | 4/1985 | Oleck et al. | 208/97 |
| 4,565,620 | A | | 1/1986 | Montgomery et al. | |
| 4,584,090 | A | * | 4/1986 | Farnsworth | 208/114 |
| 4,713,221 | A | | 12/1987 | Montgomery et al. | |
| 4,778,586 | A | * | 10/1988 | Bain et al. | 208/132 |
| 4,789,459 | A | | 12/1988 | Lumbroso et al. | 208/155 |
| 4,883,582 | A | * | 11/1989 | McCants | 208/106 |
| 4,904,372 | A | * | 2/1990 | Goelzer | 208/113 |
| 4,944,862 | A | | 7/1990 | Chen et al. | 208/49 |
| 5,009,769 | A | * | 4/1991 | Goelzer | 208/113 |
| 5,098,554 | A | | 3/1992 | Krishna et al. | 208/113 |
| 5,114,682 | A | | 5/1992 | Goelzer | 422/142 |
| 5,246,568 | A | | 9/1993 | Forbus et al. | 208/59 |
| 6,139,720 | A | * | 10/2000 | Lomas | 208/113 |
| 6,379,534 | B1 | | 4/2002 | Fung et al. | 208/93 |
| 7,381,320 | B2 | * | 6/2008 | Iqbal et al. | 208/113 |
| 7,491,314 | B2 | * | 2/2009 | Van Den Bosch et al. | 208/92 |
| 2006/0042999 | A1 | * | 3/2006 | Iqbal et al. | 208/86 |

FOREIGN PATENT DOCUMENTS

| | | | | | |
|---|---|---|---|---|---|
| CA | 2369288 | A1 | | 10/2000 | |
| RU | 2214441 | C2 | | 10/2003 | |
| SU | 408960 | A1 | | 6/1979 | |
| WO | WO/2005/003258 | | * | 1/2005 | C10G 51/02 |
| WO | WO 2006/025873 | A2 | | 3/2006 | |

OTHER PUBLICATIONS

Lappas et al., Effects of metals posoining on FCC products yields: studies in an FCC short contact time pilot plant unit, 2001, Elsevier, 65, p. 235-236.*

A. A. Avidan and R. Shinnar, Development of Catalytic Cracking Technology: A Lesson in Chemical Reactor Design, 29 Ind. Eng. Chem. Res. 931-942 (1990).*

Guide to Petroleum Product Blending, by Cud Thomas Baird IV, First Edition, Second Printing, 1989, pp. 67-77.

Slide presentation entitled "Oil Sands Market Development Issues" by Thomas H. Wise and Gareth R. Crandall presented at the Alberta Department of Energy Workshop #2—Future Business Solutions for Alberta's Oil Sands, Mar. 14, 2001.

Official Action dated Jun. 23, 2010 from Rospatent for corresponding Russian Patent Application No. 2008108823, Hedrick et al. This Official Action describes the relevance of SU 408960 A1.

* cited by examiner

*Primary Examiner* — Randy Boyer
(74) *Attorney, Agent, or Firm* — James C Paschall

(57) ABSTRACT

A process for improving flow properties of crude may include processing a first crude stream, which may in turn include cracking the first crude stream with fresh catalyst to form a cracked stream and spent catalyst, and then mixed with an unprocessed second stream. The spent catalyst may be regenerated to form fresh catalyst, which may then be recycled. At least part of the cracked stream may be mixed with a second crude stream. A ratio of the second crude stream to the first crude stream may be between about 0.5:1 and about 9:1. A ratio of part of the cracked stream to add to the second crude stream may be selected to achieve a API gravity of at least about 18. The first crude stream may be heated and stripped before being cracked.

15 Claims, 2 Drawing Sheets

10
1
3
5
18
20
21
22
30
31
32
33
34
35
36
37
39
40
41
42
43
44
44a
45
46
46a
47
48
49
50
51
52
53
54
55
70
71
72
73
74
75
80
81
82
83
84
85
86
90
94
95
96
99
100
101
102
200
201
202
203
205
300
302
303
304
310
312
320
322
400
401
402
404
499
500
502
503
600
602
604
606
608
610
612
614
616
620
622
624
626

PROCESS AND APPARATUS FOR IMPROVING FLOW PROPERTIES OF CRUDE PETROLEUM

BACKGROUND OF THE INVENTION

The present invention relates to a novel process and apparatus for improving the flow properties of crude petroleum.

RELATED PRIOR ART

When drilling for oil in remote places, is considerable expense is associated with transporting the crude oil from the wellhead to a receiving facility. One difficulty of transporting crude oil is that certain crude oils may contain a significant quantity of wax, which has a high boiling point. The temperature at which the wax gels is the pour point. The temperature at which the wax solidifies is the cloud point. In instances where the cloud point or the pour point of a waxy crude oil is higher than the ambient temperature, the likelihood of wax solidification and buildup is a serious threat to a continuous transportation of crude oil. Clearing a pipeline that has become clogged with wax or gelled crude is very expensive and time-consuming.

Another specification for pipeline pumpability is the viscosity of the oil. The viscosity of the oil is proportional to the duty required to pump it. Hence, each pipeline has a viscosity, API and pour point specification. For example, to be accepted for shipment in the Enbridge Pipeline system in Canada and the U.S., the viscosity specification is 350 Centistokes (cSt) at the pipeline operating temperature, which varies seasonally.

Still another specification for pipeline pumpability is American Petroleum Institute (API) gravity index. Crude oil is often described in terms of "lightness" or "heaviness" by the API gravity index. A high number denotes a "light" crude, and a low number denotes a "heavy" crude.

Bitumen is a viscous product that may be difficult to transport in a pipeline. Natural bitumen is natural asphalt (tar sands, oil sands) and has been defined as rock containing hydrocarbons more viscous than 10,000 cp. Bitumen, for example, from Canada's Cold Lake, is about 10 API and requires upgrading to pipeline specifications, typically at least about 18 API. Bitumen often has a high quantity of nickel, vanadium, and Conradson carbon, and is high in other contaminants, and therefore may not be suitable as a direct feedstock to a fluid catalytic cracking (FCC) unit.

A petroleum product with good flow properties such as low pour point, high API gravity, and low viscosity is desired by refiners.

Several processes have been implemented for dealing with slow crude oil flow in pipelines. In one process, the pour points of waxy crude oils have been improved by the removal of a part of the wax by solvent extraction at low temperatures. However, there is substantial expense in recovering the solvent, disposing of the wax, and cooling the temperature to sufficiently low temperatures.

In another process, waxy crude oil is diluted with an external source of lighter fractions of hydrocarbons. However this process uses a relatively large amount of expensive hydrocarbon solvents to transport a relatively cheap product. Furthermore, large quantities of lighter hydrocarbons are hard to obtain in remote locations.

A yet another process for improving crude oil flow involves thermally cracking the crude oil so as to reduce or eliminate waxy paraffin molecules by converting them to lighter hydrocarbons. Sufficient heat is supplied to waxy paraffin molecules to initiate thermal cracking. However, thermally cracking the crude oil may not lower the pour point or the viscosity of crude oils enough to create a desirable material for mixing with crude for transport through a pipeline. Thermal processing such as visbreaking can create a stability problem that produces asphaltene precipitation in the pipeline.

FCC is a catalytic process for converting heavy hydrocarbons into lighter hydrocarbons by contacting the heavy hydrocarbons in a fluidized reaction zone with a catalyst composed of finely divided particulate material. Most FCC units now use zeolite-containing catalyst having high activity and selectivity. As the cracking reaction proceeds, substantial amounts of highly carbonaceous material referred to as coke are deposited on the catalyst, forming spent catalyst. High temperature regeneration burns coke from the spent catalyst. The regenerated catalyst is then cooled before being returned to the reaction zone. Spent catalyst is continually removed from the reaction zone and replaced by essentially coke-free catalyst from the regeneration zone. FCC reaction and regeneration must be powered continually to keep the process running. In remote locations external power resources may be difficult to obtain and are very expensive.

In remote oil fields, a system for extracting and transporting crude oil without need of an external source of power while continuously creating a desirable product that can be transported through a pipeline would be desirable.

SUMMARY OF THE INVENTION

One aspect of the invention is directed to a process for improving flow properties of a crude petroleum product by cracking a first crude stream and mixing at least part of the first crude stream with a second crude stream. This aspect includes processing a first crude stream which may include cracking the first crude stream with fresh catalyst to form a cracked stream and spent catalyst. The cracked stream may be separated from the spent catalyst. The spent catalyst may be regenerated to form fresh catalyst, which may then be recycled. At least part of the cracked stream may be mixed with a second crude stream. The first crude stream may be stripped before being cracked. In another aspect, the first crude stream has at least one of the following properties: an API gravity of less than 18, a viscosity of greater than 10,000 cSt at 38° C. and a pour point of greater than 20° C. In a further aspect, a ratio of a part of the cracked stream to the second crude stream is selected to achieve at least one of the following properties an API gravity of at least 18, a viscosity of no more than 10,000 cSt at 38° C. and a pour point of no more than 20° C.

Advantageously, when using this process, the cracked stream may be separated into bottoms, light cycle oil, and naphtha, wherein the light cycle oil may be combined with the second crude stream. The naphtha may be debutanized to form liquefied petroleum gas and gasoline, wherein these two products may be mixed with the second crude stream. The bottoms, light cycle oil, liquefied petroleum gas and gasoline may each have a respective proportion, and during the mixing step, each respective proportion may be selected to achieve an API gravity of at least about 18.

In a further aspect of the invention, the regeneration of the catalyst may form a regeneration flue gas which may be burned in a boiler to generate steam. The steam may be superheated. The regeneration step partially burns coke on the spent catalyst to form regeneration flue gas having a $CO/CO_2$ ratio of between about 0.6:1 and about 1:1.

In a further aspect, the mixture of a part of the cracked stream and the second crude stream is transported in a pipeline over 20 miles from the where they were mixed to a processing station.

In yet another aspect of the invention, the first crude stream may include bitumen, and the process may include deasphalting the bitumen with solvent prior to the cracking step. The deasphalting step may form pitch which may be burned in a boiler to generate steam.

In still another aspect of the invention, an apparatus for reducing crude pour point may comprise: a riser charged with fresh catalyst and having a bottom and a top, wherein a crude conduit delivers a first crude stream into the bottom and an outlet withdraws spent catalyst and a vaporized cracked stream from the top. A vessel containing a cyclone may be in flowable communication with the outlet for receiving and separating the vaporized cracked stream from the spent catalyst. A regenerator may be in flowable communication with the vessel for receiving and regenerating the spent catalyst to form the fresh catalyst. A standpipe may be connected between the riser and the regenerator for recharging the riser with the fresh catalyst. A fractionator may be in flowable communication with the vessel for receiving the vaporized cracked stream for fractionating it into light ends, naphtha, light cycle oil and bottoms, and lines in flowable communication with the fractionator may deliver at least part of the naphtha and at least part of the light cycle oil to a second crude stream. Additionally, a feed line from the fractionator is in flowable communication with the riser.

DETAILED DESCRIPTION OF THE INVENTION

Figures 1, 3:
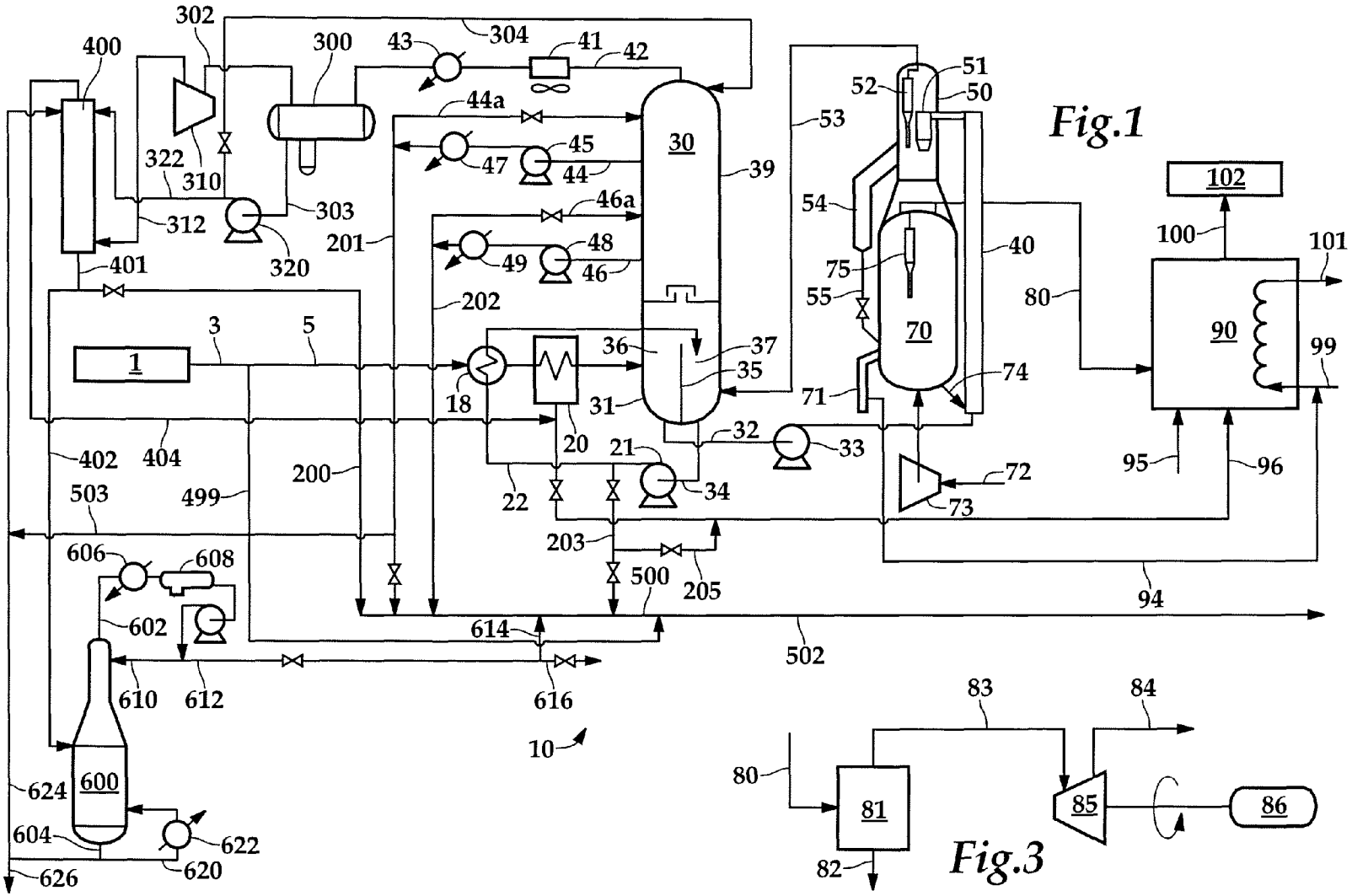
FIG. 1 is a flow scheme showing the overview of the process and apparatus.
FIG. 3 is a flow scheme of the power recovery unit.

This invention may improve the flow properties of a crude petroleum. The process may make cutter stock from a portion of a crude oil using modularly designed components. Crude oil may comprise the crude feed to be catalytically cracked by a fluidized catalytic cracking (FCC) process and the product may be mixed with unprocessed crude oil to create a blend of processed and unprocessed crude to improve the flow properties of the crude by lowering the crude pour point, raising the API and/or reducing the viscosity for easing transport of the blended product through a pipeline to a remote location for further processing.

Residual fluidized catalytic cracking (RFCC) may be used to process Conradson carbon residue and metals-contaminated feedstocks such as atmospheric residues or mixtures of vacuum residue and gas oils. Depending on the level of carbon residue and nickel and vanadium contaminants, these feedstocks may be hydrotreated or deasphalted before being fed to an RFCC unit. Feed hydrotreating or deasphalting reduces the carbon residue and metals levels of the feed, reducing both the coke-making tendency of the feed and catalyst deactivation.

This invention has a highly integrated flow scheme that minimizes the amount of equipment needed and may be as self-contained as possible. Any excess energy generated in the complex may be used to generate steam that can be exported to the oil field for steam flooding. The power need for the complex can be generated at high efficiency by using steam from a CO boiler which is highly pressurized and superheated or by a power recovery expander on a flue gas line from the catalyst regenerator. Such a complex should have excess power and extracted steam because the coke yield is very high in comparison to a standard FCC reaction. Generating power to run the complex with process gas or high quality steam generated by the CO boiler plus steam extraction is expected to be synergistic in the oil field because enhanced oil recovery methods need medium pressure saturate steam which is generally in excess in a refinery. The oil field also requires electricity to run the pumps extracting the crude from the earth.

Crude oil from a source may comprise all or part of a crude feed to be processed by FCC. Crude feed processed by this invention may be heavy hydrocarbon comprising heavy oil or bitumen. Whole bitumen may include resins and asphaltenes, which are complex polynuclear hydrocarbons, which add to the viscosity of the crude oil and increase the pour point. Crude feed may also include conventional crude oil, atmospheric tower bottom products, vacuum tower bottoms, coal oils, residual oils, tar sands, shale oil and asphaltic fractions.

Crude oil is typically very viscous, having a API gravity of between about 8 and about 13 API and typically less than 18 API and/or a pour point of between about 20 and 50° C. Viscosity of crude oil may be between about 10,000 and about 15,000 cSt at about 40° C. Crude oil may be characterized as a hydrocarbon stream having properties in at least one of the following ranges: pour point of greater than about 20° C., viscosity greater than about 10,000 cSt at about 38° C. (100° F.) and an API gravity typically greater than 18 API.

Processing Apparatus

Referring to FIG. 1, apparatus 10 delivers a crude oil from the oil field ground 1 in line 3. The crude oil stream in line 3 is typically subjected to heating and separation of an oil from a water phase to dewater the crude oil stream in line 3. The crude oil stream in line 3 is separated into two portions. One crude stream is carried in line 5 for processing while the other crude stream is carried in line 499 to bypass the processing of line 5. The crude oil may be sent to a fired heater 20 where the crude oil may be preheated. Optionally, the crude oil in line 5 may also be heated in heat exchanger 18 by indirect heat exchange with bottoms recycle in line 22. After leaving heater 20, the heated crude oil may be introduced into lower portion 31 of fractionator 30. In some FCC processes, the crude oil is not directed to fractionator 30 but is instead introduced directly to riser 40 for catalytic cracking.

The recovery of resids, or bottom fractions, involve selective vaporization or fractional distillation of the crude oil with minimal or no chemical change in the crude oil. The fractionating process may provide a feed stock more suitable for FCC processing. The selective vaporization of the crude oil takes place under non-cracking conditions, without any reduction in the viscosity of the feedstock components. Light hydrocarbons, those boiling below about 700° F. (about 371° C.), preferably those boiling below about 675° F. (about 357° C.), and most preferably those boiling below about 650° F. (about 343° C.), are flashed off of the crude oil in feed zone 36. The light hydrocarbons typically are not catalytically cracked. Hence, the feed zone 36 serves as a stripper in which light hydrocarbons are stripped from the crude feed.

Crude feed may be fed directly to a riser 40 without the fractionating step, depending on the quantity of light ends, gasoline, gas oils and residuals. Direct feeding would be desirable if the quantity of hydrocarbons boiling below about 650° F. (about 343° C.) is relatively low and their segregation therefore unnecessary. The bottoms product of fractionator 30, in feed zone 36 is withdrawn via FCC feed line 32 and directed by pump 33 to the bottom of the riser 40.

The feed rate to apparatus 10 may be between about 50,000 and about 200,000 barrels per day, preferably between about 75,000 and about 150,000 barrels per day, and more preferably about 100,000 barrels per day although the feed rate could vary from these ranges. Feed to the FCC may be between 10 LV-% and about 60 LV-% of the complex charge in line 3 from the oil field 1 with lower rates being preferable to higher rates unless utility balances require higher charge rates. The feed in line 32 is contacted with catalyst in the riser 40 and cracked into lighter hydrocarbon products which are carried out of the riser 40. The catalyst becomes spent as carbon residue builds up on the catalyst surface. The spent catalyst and the products are transported out of the top of riser 40 and into a reactor vessel 50 optionally through a rough cut separator 51 to disengage product vapors from the spent catalyst. One or more stages of cyclones 52 further separate the spent catalyst from the products by inducing the mixture of catalyst and product gases to swirl so that the heavier spent catalyst travels downwardly and the lighter gaseous products travel upwardly.

Approximate operating conditions include heating the crude feed for catalytic cracking to between about 300 and about 500° F. (between about 149 and about 260° C.), preferably between about 350 and about 450° F. (between about 177 and about 232° C.), and more preferably about 400° F. (about 204 degrees). The temperature in reactor vessel 50 may be between about 850 and about 1100° F. (between about 454 and about 593° C.), preferably between about 900 and about 1050° F. (between about 482 and about 566° C.), and more preferably between about 950 and about 1000 F (between about 510 and about 538° C.). Apparatus 10 may regenerate catalyst at between about 1100 and about 1500° F. (between about 593 and about 896° C.), preferably between about 1200 and about 1400 (preferably between about 649 and about 760° C.), more preferably between about 1220 and about 1350° F. (between about 660 and about 732° C.). The FCC conversion may be between about 60 and about 80 LV-% to gasoline and lighter products, preferably between about 65 LV-% and about 75% LV-% to gasoline and lighter products, and more preferably about 70 LV-% to gasoline and lighter products.

Continuing with FIG. 1, the vapor products exit the top of reactor vessel 50 and may be directed via line 53 to product zone 37 in lower portion 31 of fractionator 30. Heat from product vapors may be absorbed within fractionator 30 so that the vapors are desuperheated and the primary product separation takes place. The heat required for the separation of the products in fractionator 30 is primarily provided by the cracked product stream. Thus, in the case that the crude feed is sent directly to riser 40, no other heat is input to fractionator 30. The fractionation of product fed to product zone 37 may be by heat removal, rather than heat input. The heat may be removed from the fractionator by a series of pump-around exchanger flows coupled with fractionator bottoms steam generation and overhead cooling in the form of an air/water cooled condenser.

Fractionator

Continuing with FIG. 1, the fractionator column 30 may be a divided-wall fractionator with a partition 35 positioned vertically to isolate a feed zone 36 from a product zone 37 at the bottom of the fractionator 30. Partition 35 may be formed of at least one baffle that is generally imperforate (at least about 80% imperforate, preferably about 90% imperforate). Multiple baffles may be used. The crude oil is directed to feed zone 36 and heated to a temperature between about 600 and about 800° F. (between about 315 and about 427° C.), preferably between about 650 and about 750° F. (between about 343 and about 399° C.), and most preferably a temperature of about 700° F. (about 371° C.) at a pressure of between about 5 and about 15 psig (between about 1.3 and about 2 atm), preferably between about 7 and about 13 psig (between about 1.5 and about 1.9, and most preferably about 10 psig (about 1.7 atm). The light hydrocarbons stripped from the crude oil may leave upper portion 39 of fractionator 30 and may comprise light naphtha product flowing through line 42, net heavy naphtha product flowing through line 44, and/or net light cycle oil product flowing through line 46. The light naphtha product in line 42 may be condensed by a condenser 41 and a steam generator 43 before it is directed to overhead receiver 300. Water is decanted from the receiver 300 while vaporous wet gas is separated in line 302 from unstabilized naphtha liquid in line 303. The wet gas is expanded in expander 310 and fed to the bottom of an absorber column 400 via line 312. Whereas, the unstabilized liquid naphtha is compressed in compressor 320 and fed to a top of the absorber column 400 via line 322. A portion of the unstabilized naphtha is refluxed to the fractionator column 30 via line 304. In the absorber column 400, the unstabilized liquid naphtha absorbs liquefied petroleum gas (LPG) from the wet gas and exits the absorber column 400 in absorbent line 401 comprising $C_3$+. The absorbent line is split between product line 200 for delivering $C_3$+ to line 500 for blending and a debutanizer feed line 402. In an embodiment, heavy naphtha in line 201 is diverted via line 503 to line 624 to supplement the naphtha feed to the absorber column and increase the recovery of LPG in line 401. Dry gas comprising $C_2$−, $H_2S$ and $H_2$ exit the absorber column 400 in dry gas line 404. Dry gas is carried by dry gas line 404 to fuel the fired heater 20 and/or a CO boiler 90 via line 96. Dry gas in line 404 may also be directed to a gas turbine for the generation of electricity.

Fractionator 30 may condense superheated reaction products from the FCC reaction to produce liquid hydrocarbon products. Fractionator 30 may also provide some fractionation (or stripping) between liquid side stream products. After the vapor products are cooled from temperatures of between about 900 and about 1050° F. (between about 482 and about 966° C.), preferably between about 950 and about 1000° F. (between about 510 and about 537° C.), and more preferably about 970 F (521° C.) to temperatures of about between about 50 and about 150° F. (between about 10 and about 66° C.), preferably between about 70 and about 120° F. (between about 21 and about 49° C.), and more preferably about 100 F (about 38° C.), the vapor products are typically condensed into liquid products and the liquid products are transported out of fractionator 30 and directed to mix with unreacted crude in line 500. Typically, anything heavier than $C_5$ may stay in the liquid phase, and anything lighter may stay vaporized as light ends and may be transported out of fractionator 30 in overhead line 42. The liquid products taken as cuts from fractionator 30 typically may comprise light cycle oil (LCO), fractionator bottoms or clarified oil, heavy cycle oil (HCO), and heavy naphtha (gasoline). In FIG. 1, HCO does not have a separate cut but is collected in the bottoms. The heavy naphtha stream in line 44 is withdrawn from the fractionator column 30 by a pump 45 and cooled in steam generator 47. A reflux portion is returned to the column at a higher location via line 44*a*. Heavy naphtha line 201 takes the remainder to line 500. Line 503 may take some or all of the heavy naphtha to the debutanizer column 600 via line 402. Similarly, the LCO stream in line 46 is withdrawn from the fractionator column 30 by a pump 48 and cooled in steam generator 49. A reflux portion is returned to the column 30 at a higher location via line 46*a*. LCO line 202 takes the remainder to line 500. Lastly, clarified oil is removed in bottoms line 34 from the fractionator column 30 by a pump 21 and a return portion is cooled in a feed heat exchanger 18 and returned to the product zone 37 of the column 30 isolated from the feed side 36 by partition 35. Net bottoms line 203 may take a remainder of the clarified oil to line 500 for blending or be diverted to the CO boiler 90 through lines 205 and 96.

FCC Products

Catalyst most appropriate for use in riser 40 are zeolitic molecular sieves having a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. Y zeolites with low rare earth content may be the preferred catalyst. Low rare earth content denotes less than or equal to about 1.0 wt-% rare earth oxide on the zeolite portion of the catalyst. The catalyst may be dispersed on a matrix comprising a binder material such as silica or alumina and/or an inert filer material such as kaolin. It is envisioned that equilibrium catalyst which has been used as catalyst in an FCC riser previously or other types of cracking catalyst may be suitable for use in the riser of the present invention.

The FCC system cracks most of the crude feed into material in the $C_5$+ range boiling at 400° F. These products have may an API gravity of between about 30 and about 60, preferably of between about 35 and about 55, and more preferably of between about 40 and about 50, and therefore contribute significantly to the increase in the net API of the blended stream in line 502. Catalytic cracking of the crude oil maximizes the API gravity increase while processing a minimum amount of crude oil.

The combined liquid product from the FCC processing of crude oil may contain converted products from the crude oil or bitumen feedstock and may be transported in line 500. The liquid product from the processing of the crude oil is characterized as having an API gravity of at least about 30, preferably greater than about 35, and more preferably greater than about 37. The liquid products may also have a viscosity of less than about 2 cSt, preferably less than about 1.5 cSt and more preferably less than about 1 cSt at 122° F. (50° C.). The liquid products formed may have a pour point less than about 40° F. (about 4° C.), preferably less than about 30° F. (about −1° C.), and more preferably less than about 25 F (about −3.8° C.). The combined liquid conversion products from the processing of the heavy oil by FCC are lighter and less viscous by virtue of the reduction in molecular weight. More cracking in the FCC may result in lower viscosity and density of the product.

The exact quantity of feed which is necessary to be processed depends on the specific acceptance requirements of the pipeline for pumpability. These may be specified as maximum density or minimum API gravity, maximum viscosity at a certain temperature, maximum pour point or any combination of these specifications. Any of the aforementioned specifications could be the limiting factor for the amount of processing needed, depending on the crude type or the specification. In addition, the specifications may be different for different times of the year due to changing pipeline operation temperatures. Adjustment of the conversion level of the FCC or of amount processed can be exercised as a convenient way to meet the specifications at minimum operating cost.

The liquid products from the FCC reaction are mixed with unprocessed crude oil stream in line 499 to form a mixed crude oil suitable for transport in line 502. Between about 5 LV-% and about 60 LV-% of the crude oil in line 3 may be FCC processed and added to unprocessed or unreacted crude stream in line 499, preferably between about 10 LV-% and about 40 LV-% of crude feed may be processed and added to unprocessed crude, more preferably about 30 LV-% of crude feed may be processed and added to unprocessed crude by volume. A ratio of the unprocessed crude oil to the liquid products added may be between about 0.5:1 and about 9:1, preferably between about 1:1 and about 4:1, more preferably between about 2:1 and about 3:1. Absorber underflow carried in line 200, as well as all of the other liquid streams from fractionator 30, may be combined with unprocessed crude. Depending on the site requirements or crude grade desired, it may be desirable to burn all or part of the clarified oil in bottoms line 34 to balance the site energy needs or to upgrade the quality of the crude stream in line 500 and/or 502.

Debutanizer

In a still further embodiment, the absorber underflow in line 401 may also be sent to the debutanizer fractionation column 600 via line 402 to separate LPG from naphtha. Fractionation yields an $C_4$− overhead in line 602 which is condensed in condenser 606 with the production of steam and dewatered in receiver 608. The dewatered LPG is pumped and split between reflux line 610 which is returned to the debutanizer 600 and recovery line 612. Recovery line 612 is split between a blend line 614 which blends LPG with the processed products in line 500 and an optional product line 616 which recovers LPG as product which may be stored and/or sold locally. LPG is an excellent cutter component, but because of its high vapor pressure can be blended only up to the flash specification. Hence, the split between lines 610 and 612 and 614 and 616 should be set to maximize the LPG blended in line 500 up to the flash specification. Any excess can be captured and sold as LPG or used in the fired heater 20 or the CO boiler 90. The debutanizer column 600 also produces a bottoms stream in line 604 typically comprising $C_5$+ material. The bottoms stream 604 is split between a reboil line 620 which is heated by reboiler 622 and returned to the debutanizer column 600 and a naphtha recovery line 624 which recovers naphtha to be preferably returned to the top of the absorber column 400 or recovered as product in line 626 to be stored and/or sold locally.

Blended Product

As shown in FIG. 1, the separate conversion products; heavy naphtha in line 201, LCO in line 202 and absorber underflow in line 200 are combined in line 500 where they combine with unprocessed crude oil from line 499, thus forming a blended stream 502, or a synthetic product. The unprocessed crude oil may be supplied directly from the oilfield, but more preferably may be stripped to remove light hydrocarbons and dewatered. In an alternate embodiment, a portion of one or more of the conversion products is taken off as a side-product and further treated or processed as a saleable commodity. If this option is desired, a greater portion of the feed will need to be processed in the FCC to make up for a loss of low viscosity material for blending.

Liquid products may include bottoms, light cycle oil, and naphtha, and the portions of each one may be selected to combine with the unprocessed crude to achieve desired flow properties. The unprocessed crude may be a portion of the crude source that was not FCC processed. Specifically, all liquid streams may be combined with the unprocessed crude. The naphtha may be directed to a debutanizer (not shown) to form liquefied petroleum gas (LPG) and gasoline. The LPG and the gasoline may be added to the unprocessed crude, in selected amounts to achieve desired flow properties. The ability to modify the relative amounts of light hydrocarbons (propane through pentane) in the blended pipeline crude is advantageous because it may be held in tankage and therefore subjected to a still further specification of Reid vapor pressure (RVP) to minimize the boil-off of material at ambient conditions which may violate environmental regulations, cause material loss to flaring or require expensive vapor recovery systems. LPG addition to the unprocessed crude must be gauged to balance vapor pressure and flow properties.

The blended stream in line 502 may have the following characteristics, about 18 API or greater, preferably at least about 19 API, more preferably greater than about 19.5 API. The blended stream may have a viscosity at about 100° F. (about 38° C.) of no more than about 10,000 cSt, preferably no more than about 5000 cSt, and more preferably no more than about 25 cSt. The blended stream may also have a pour point of no more than about 20° C., preferably no more than about 15° C., and more preferably no more than about 0° C. The blended stream may then be pumped in a pipeline 502 to a remote location for further processing such as in a refinery or a distribution station. A remote location is typically greater than 20 miles away from the well in the oil field 1.

Catalyst Regeneration

As shown in FIG. 1, the spent catalyst separated from products by cyclones 52 fall downwardly into a bed and are stripped of hydrocarbons by steam in stripper 54 and delivered via spent catalyst conduit 55 regulated by a valve to a regenerator 70. In the regenerator, 70 coke is burned off of the surface of the spent catalyst to produce a fresh or regenerated catalyst. Air is pumped from line 72 by blower 73 and enters the bottom of regenerator 70 to burn the coke at a temperature of between about 900 and about 1600° F. (between about 482 and about 871° C.), preferably between about 1000 and about 1400° F. (between about 538 and about 760° C.), more preferably between about 1200 and about 1300° F. (between about 649 and about 704° C.). After the coke has been substantially burned off, the spent catalyst becomes fresh catalyst again. The carbon that has been burned off makes up regeneration flue gas containing $H_2$, CO, $CO_2$, and light hydrocarbons. Cyclones 75 separate regenerated catalyst from the regeneration flue gas. Regenerated catalyst may be returned to riser 40 via regenerated catalyst conduit 74 to contact incoming crude feed in line 32.

The regeneration flue gas may be carried out of regenerator 70 by flue line 80 and into CO boiler 90. The CO/$CO_2$ ratio in the regeneration flue gas in stream 80 may be between about 0.6:1 and about 1:1, preferably between about 0.7:1 and about 0.99:1, more preferably about 0.9:1. Running regenerator 70 in partial burn is most appropriate for use with heavy residuals where regenerator heat release and air consumption are high due to high coke yield. In addition, oxygen-lean regeneration offers improved catalyst activity maintenance at high catalyst vanadium levels, due to reduced vanadium mobility at lower oxygen levels. By running regenerator 70 in deep partial burn to maximize the CO yield the unit will limit the amount of heat that could be released if the carbon were allowed to completely burn to $CO_2$. This will lower the regenerator temperature and permit a higher catalyst to oil ratio.

The heating value of the CO-containing gas may be low due to dilution with much nitrogen, therefore for efficient burning an auxiliary fuel such as dry gas is optionally injected in line 96 with air in line 95 to promote combustion and heat the burning zone to a temperature at which substantially all CO is oxidized to $CO_2$ in CO boiler 90. In the CO boiler 90 the regeneration flue gas reaches temperatures of at least about 1500° F. (about 815° C.), preferably at least about 1700° F. (about 926° C.), and more preferably at least about 1800° F. (about 982° C.). The combustion in the CO boiler 90 heats and vaporizes water fed by water line 99 to generate high pressure superheated steam which leaves CO boiler through steam line 101 for use in the FCC complex. The regeneration flue gas containing $CO_2$ leaves the CO boiler 90 and is released to the stack 102. The dry gas in line 96 may originate from the overhead line from the absorber 400. An alternative auxiliary fuel may comprise clarified oil diverted from line 203 in line 205.

In addition to running the regenerator 70 in deep partial burn, additional heat may be removed from the regenerator 70 through the operation of a catalyst coolers on the regenerator 70. The regenerator may be equipped with between about 1 and about 5 catalyst coolers, more preferably about 2 and about 4 catalyst coolers 71, and more preferably about 3 catalyst coolers. Catalyst coolers may remove heat through steam generation. The steam from the catalyst coolers 71 may be delivered via line 94 to the CO boiler 90 to be superheated in the CO boiler.

Power Recovery

The regenerator flue gas may optionally be directed via line 80 to a power recovery unit, as shown in FIG. 3, before it is delivered to the CO boiler 90 as an alternative to the delivery of regenerator flue gas directly to the CO boiler 90. In the CO boiler air and fuel gas are mixed with the flue gas and burned to convert the CO to $CO_2$.

As shown in FIG. 3, the power recovery unit, passes the regenerator flue gas through third stage separator 81 to remove catalyst fines in the flue gas stream. The catalyst fines are then directed out of third stage separator 81 via underflow line 82. The clean flue gas is then directed via line 83 to power recovery expander (or turbine) 85 which turns a shaft powering an electric power generator 86 and or the air blower 73 for the regenerator. Flue gas from expander 85 is directed via expander line 84 to the CO boiler 90 shown in FIG. 1.

It is also contemplated that dry gas in lines 404 and 96 could be sent to a gas turbine (not shown) for the generation of electricity if power demands are more crucial than steam demands. The hot exhausted gas from the gas turbine could then be sent to a CO boiler 90 to supplement heating requirements therein.

Apparatus 10 may be economic at large or small scales and may be an ideal fit for remote oil fields that lack on-site energy to produce the required steam, lack light oil that may be required as cutter stock for transport, or are inaccessible to refineries capable of processing heavy oil. Apparatus 10 may have a multiplicity of risers 40, reactor vessel 50, regenerator 70, and fractionator 30. A stacked arrangement of riser 40, disengaging zone 50, and regenerator 70 will both decrease the investment cost and the plot area of the vessels.

The pour point and viscosity of crude oil in crude stream 3 is lowered, and the API increased, by catalytically cracking a portion in the crude stream 5 into lighter products and mixing those products with unreacted crude oil in stream 499. Apparatus 10 also produces energy through regeneration flue gases directed to the CO boiler. Apparatus 10 is a self-contained system that increases the flow properties of crude oil while not needing significant external power. Apparatus 10 may generate about 100% of the energy needed to run itself plus an excess that can be used to pump oil from the ground. An excess of steam is also generated which can be used to dewater the crude and flood the oil field for enhanced oil recovery. The size of the apparatus 10 can be increased beyond the size required to upgrade the crude to 18 API until the total energy needs of the process and oil field are balanced.

Bitumen Containing Crude Feed

A typical bitumen assay, for example from Canada's Cold Lake (CCL), may have the following properties. Bitumen may have a API gravity between about 9 and about 12 API, and preferably between about 10 and about 11 API. Bitumen may have a sulfur content of between about 3 and about 5 wt-%, and preferably between about 3.5 and about 4.5 wt-%. Bitumen may have a nitrogen content of between about 0.1 and about 0.4 wt-%, and preferably between about 0.2 and about 0.3 wt-%. Bitumen may have a Conradson carbon residue content of between about 11 and about 14 wt-%, and preferably between about 12 and about 13.5 wt-%. Bitumen may have a nickel and vanadium content in ppmw of between about 250 and about 280, and preferably between about 255 and about 270. Bitumen may have a TAN content in mg of KOH/g of between about 1 and about 2, and more preferably between about 1.2 and about 1.5.

The contaminants contained in bitumen are much higher than most crude oils and direct processing in an FCC would be possible only with very high coke yield, necessitating multiple catalyst coolers 71 and a very high catalyst replacement rate due to accumulation of metals.

Solvent Deasphalting

Figure 2:
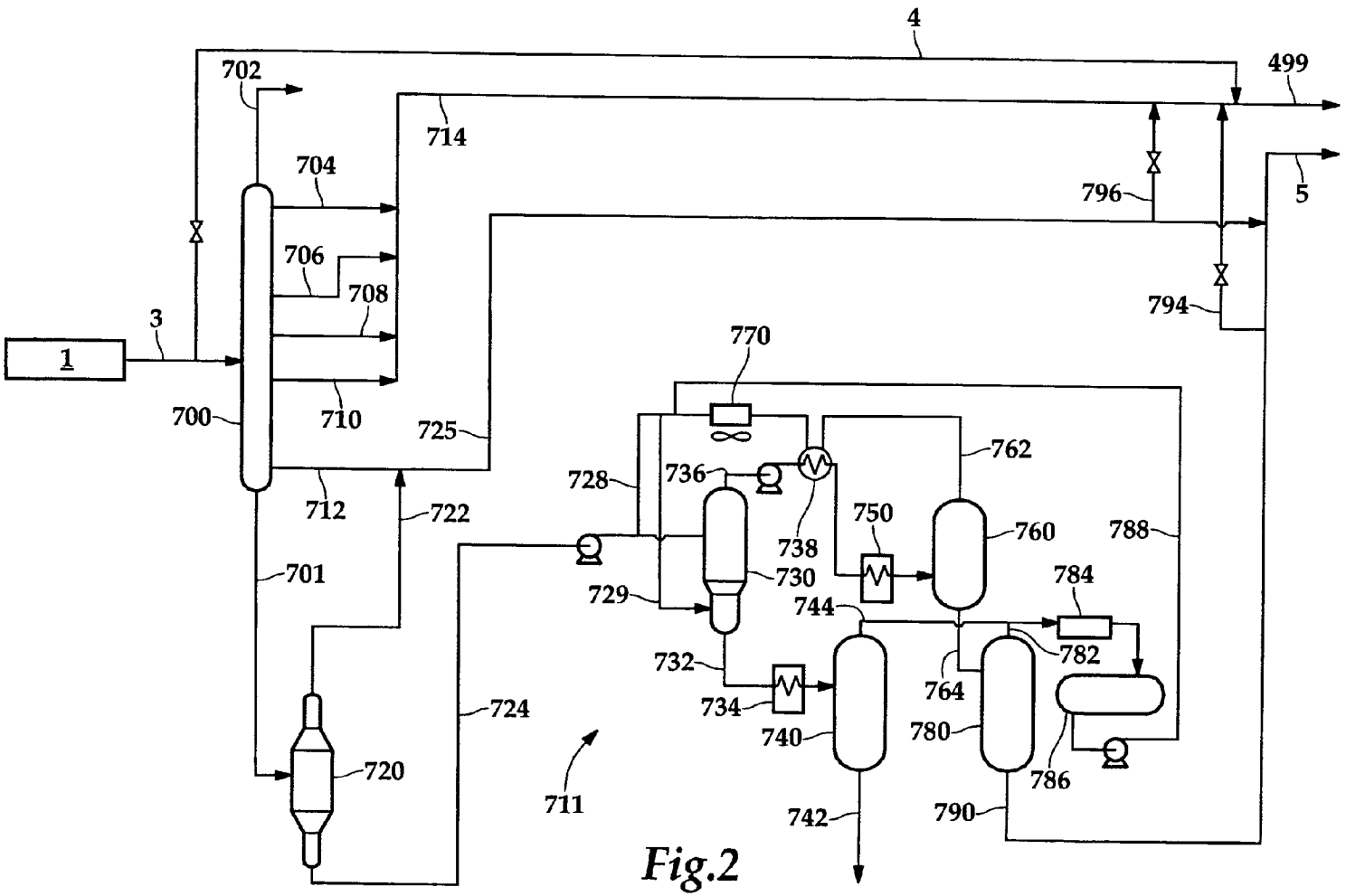
FIG. 2 is a flow scheme of a bitumen processing complex.

As shown in FIG. 2, an alternate embodiment of the invention in which line 3 includes bitumen. Bitumen is natural asphalt (tar sands, oil sands) and has been defined as rock containing hydrocarbons more viscous than 10,000 cp or else hydrocarbons that may be extracted from mined or quarried rock. Other natural bitumens are solids, such as gilsonite, grahamite, and ozokerite, which are distinguished by streak, fusibility, and solubility. Bitumen containing feed may be processed upstream of line 5 which effects the split between line 3 and line 499 of FIG. 1. Bitumen-containing feed in line 3 may be first separated in an atmospheric fractionation column 700 to provide fuel gas in an overhead line 702, light straight run naphtha in line 704, heavy naphtha in line 706, kerosene in line 708, middle distillate in line 710 and atmospheric gas oil in line 712. Variations of these cuts may be obtained such as fewer side cuts from the atmospheric column 700. Lines 704, 706, 708 and 710 are combined to provide line 714. Optionally, a bottoms stream from the atmospheric column 700 is delivered in bottoms line 701 to a vacuum distillation column 720 which is run under vacuum conditions. An overhead line 722 from the column 720 containing vacuum gas oil is combined with line 712 to form line 725. A vacuum bottoms in line 724 is transported to solvent/deasphalting apparatus 711. Alternatively, the atmospheric bottoms in line 701 is sent directly to the solvent/deasphalting apparatus 711 without undergoing vacuum distillation, omitting the need for column 720.

In the solvent deasphalting process, the vacuum bottoms in line 724 is pumped and admixed with a solvent from line 728 before entering into an extractor vessel 730. Additional solvent may be added to a lower end of the extractor vessel 730 via line 729. The light paraffinic solvent, typically propane, butane, pentane or mixtures thereof solubilizes the heavy hydrocarbon material in the vacuum bottoms. The heavier portions of the feed are insoluble and precipitate out as pitch in line 732. The pitch in line 732 is heated in fired heater 734 and stripped in pitch stripper 740 to yield pitch in bottoms line 742 and solvent in line 744. The deasphalted oil in the extractor raffinate line 736 is pumped and heated to supercritical temperature for the solvent by indirect heat exchange with heated solvent in the solvent recycle line 762 in heat exchanger 738 and in fired heater 750. The supercritically heated solvent separates from the deasphalted oil in the DAO separator 760 and exits in the solvent recycle line 762. The solvent recycle is condensed by indirect heat exchange in heat exchanger 738 with the extractor raffinate in line 736 and condenser 770. A solvent-lean DAO steam exits the DAO separator 760 in line 764 and enters DAO stripper 780 which strips the DAO from the entrained solvent at low pressure. The solvent leaves in line 782 and joins the solvent in line 744 and is condensed by cooler 784 and stored and solvent reservoir 786. Solvent is pumped from the reservoir 786 as necessary through line 788 to supplement the solvent in line 762 to facilitate extraction. Essentially solvent-free DAO in line 790 is admixed with the gas oils mixed in line 725 to provide line 5 for the FCC unit in FIG. 1. Feed in line 5 that is processed in the embodiment of FIG. 2 may preferably bypass fractionator 30 in FIG. 1. Portions of the DAO in line 790 and gas oil in line 725 may bypass the FCC process unit by joining line 714 to form line 499 via lines 794 and 796, respectively. The equipment and processing details of solvent deasphalting are described by Abdel-Halim and Floyd in "The ROSE Process", chapter 10.2, R. A. Meyers ed. Handbook of Petroleum Refining Processes, 3 ed. McGraw-Hill 2004.

Typically 40-80 wt-% of the feed is removed as DAO containing the lowest molecular weight and most paraffinic portion of the vacuum residue and is most suitable for FCC processing. The bottoms or pitch product from the pitch stripper 740 contains a large portion of the contaminants such as Conradson carbon residue, metals and asphaltenes and has high density between about 5 and about −10 API, and commonly between about 0 and about −10 API. Since this stream does not flow well and requires heating to maintain in a liquid state, it is inconvenient to ship and therefore best used as a fuel on-site. One preferred embodiment is to inject this fuel as auxiliary fuel to CO boiler 90 of the fluidized-bed type. Another embodiment is to burn this pitch either as-such or cut with a small amount of a lighter stream in a furnace or steam-generating heater. An alternative would be to use the clarified oil in line 203 from FIG. 1 not in the blend of line 500 due to its poor value in the refinery, but as cutter stock for the pitch to improve the combustion of gasifier feed characteristics in the CO boiler 90 or other gas fired heater of FIG. 1.

A portion of the deasphalted oil in line 790 and/or a portion of the gas oil in line 724 are sent to an FCC reactor for catalytic processing at moderate to low conversion. Between about 15 wt-% and about 50 wt-% of the DAO may be catalytically cracked in the FCC, preferably between about 20% and about 40% of the DAO may be catalytically cracked, and more preferably about 30% of the DAO may be catalytically cracked. The fraction of deasphalted oil fed to the FCC is adjusted so that by dilution, the viscosity and density after mixing the FCC products with the remainder of the deasphalted oil is reduced. The resulting mixture meets specifications for a pipeline and can be advantageously delivered to a refinery as synthetic diluted bitumen which has lower metals than raw bitumen.

Products

In the process of the invention, the amount of FCC combined conversion products necessary to blend with catalytically unprocessed bitumen, deasphalted bitumen or heavy crude oil depends on the specific acceptance requirements of the pipeline for pumpability. A convenient means of determining the amount of feed necessary for the FCC process is by calculating the separate viscosities of the FCC products (either combined or separately) and for the unprocessed bitumen or deasphalted bitumen. The mixture viscosity may then be estimated by weight percent blending by the Refutas correlation (using the weight average of the Refutas index for a particular viscosity). This well-established method is described in C. Baird, Guide to Petroleum Product Blending, Austin, Tex.: HPI Consultants, 1989.

In one embodiment of the invention shown in FIG. 2, bitumen is deasphalted and a portion of this deasphalted bitumen is converted to light hydrocarbon product in FCC riser 40 of FIG. 1 and then blended with the unprocessed raw bitumen which bypassed processing in line 4 and joined line 499. In a preferred embodiment, the bitumen is deasphalted and a portion of this deasphalted bitumen is converted in the FCC riser 40 of FIG. 1 and then blended with some deasphalted but otherwise unconverted bitumen which bypassed FCC processing in line 794. This latter preferred embodiment has a significant advantage over the prior art as described in the literature. For example in the presentation "Oil Sands Market Development Issues" by T. H. Wise and G. R. Crandall. to Alberta Department of Energy Workshop #2-Future Business Solutions for Alberta's Oil Sands of Mar. 14, 2001, a wide variety of traditional synthetic crude mixtures from varying converters with bitumen are enumerated together with their target refinery type:

| Upgrader conversion | Oil Sands Product | Refinery type |
|---|---|---|
| 1. None | Bitumen Blend | Heavy Crude Coking or Asphalt |
| 2. Partial | Upgraded Heavy | Heavy Crude Coking |
| 3. Coking/Bypass or | Medium Synthetic | Coking or Asphalt Resid Hydrocracking |
| 4. Coking | Light Bottomless Synthetic | Cracking |

The option 3 in this table, "Coking/Bypass" refers to coking a portion of the feed and blending with raw bitumen and this option is widely practiced in the industry. However, this requires a relatively large proportion of feed be sent to a coker, typically between about 40 wt-% and about 45 wt-% of the feed because the products of the coker are relatively non-selective and contain a significant portion in the boiling range between about 650° F. (343° C.) and about 1050° F. (566° C.) which is several times higher in viscosity than the $C_5$-400° F. (204° C.) range, which is thus not as effective in lowering the viscosity or pour point. Another disadvantage of this prior art process is that a petroleum coke byproduct is made which is high in sulfur and not a valuable fuel for sales. It can, in fact be burned onsite, but burning of petroleum coke fuel requires solids handling, pulverization or other expensive equipment.

The last option 4 "Coking" in which all the bitumen is coked to produce a light bottomless synthetic product which is sent to a FCC-based refinery may present a difficulty. Not only is there a petroleum coke product to deal with, but the properties of the vacuum gas oil boiling range between about 650° F. (343° C.) and about 1050° F. (566° C.) make it a mediocre feedstock for catalytic cracking. Because of the thermal nature of coking, there are light products produced and therefore a hydrogen deficiency in the FCC feed resulting in relatively poorer yield pattern unless the hydrogen is replaced by hydrotreating.

The process of the invention effectively circumvents the difficulties of these two options. Depending on the pipeline specification, due to the superior yield of lighter and less viscous product, typically between about 20 wt-% and about 35 wt-% of the bitumen must be processed instead of between about 40 wt-% and about 45 wt-% required for the coker. Furthermore, a pitch product is produced which can be more conveniently burned in the complex. Further, the synthetic crude product has a boiling range between about 650° F. (343° C.) and about 1050° F. (566° C.) comprising a greater percent of virgin (unreacted) material which is higher in hydrogen content and therefore better feed for the target refiner with an FCC unit. The process of the invention, by the ability to segregate the clarified oil in the fractionator bottoms product 34 and send it to be burned or otherwise disposed of, can leave an uncracked synthetic crude in line 32 boiling in the range between about 650° F. (343° C.) and about 1050° F. (566° C.), which is particularly good FCC feed. If it were proposed in option 3 above to only use coker products boiling below about 650° F. (343° C.) to dilute the blend, an impractically large portion of the feed would require processing.

In summary, the blended pipeline pumpable synthetic crude oil of the subject invention and its several embodiments have several key advantages. The resulting synthetic crude blend has a "balanced" distillation profile, without an excess of material in the vacuum gas oil boiling range between about 650° F. (343° C.) and about 1050° F. (566° C.). The synthetic crude is therefore more similar in properties to a heavy conventional crude oil than for bitumen. The boiling range of the synthetic crude oil between about 650° F. (343° C.) and about 1050° F. (566° C.) is not filled with material having degraded properties for downstream refining by the FCC unit. In case all of the bitumen is processed through the solvent deasphalting unit, the upgraded synthetic crude is asphaltene-free and to a high degree (typically greater than about 90 wt-%) demetallized. The synthetic crude therefore has lower density and contaminant levels, making it easier to process in refineries.

Bitumen Feed Byproducts

In the case of bitumen, the FCC unit will be processing a sulfur-containing heavy oil stream, and the coke burned in the regenerator will have a significant amount of sulfur and thus require a pollution control device. The FCC unit also will likely require management of the large heat release of the coke load by operating in partial burn mode, thus a waste heat boiler is required to burn the residual carbon monoxide. One such waste heat boiler often used in such instances is a pressurized fluid bed boiler, such as sold by Foster Wheeler, Ltd. in which limestone granules are fluidized in a fluid bed. The sulfur in the hot flue gas reacts with the limestone to produce calcium sulfate which is recovered in a baghouse. The CO is burned in the high temperature of the fluid bed, augmented by firing it with a supplemental fuel. Pitch, formed during the deasphalting step, is difficult to burn because of its high viscosity. However, in a fluid bed, it is not necessarily required to atomize this material and it can be added directly with no special nozzle requirements because of the high thermal mass of the hot solid material acts to ensure efficient combustion. Thus, a good use of the pitch produced by the solvent deasphalting unit is as a low-value supplemental fuel in a waste heat CO-burning boiler, such as CO boiler 90. Practicing the invention this way solves the problem that the pitch is itself extremely high in sulfur (about 8 wt-%) and burning it requires pollution control, so this method of operation makes optimal use of equipment.

The pitch may be used to create steam, generate power, or the steam produced in the extraction of bitumen from the oilfield may be used in an environmentally responsible way because the lowest value portion of the bitumen is used to produce the necessary steam for the extraction technique. Other ways of arranging the equipment are possible, in the interest of improving thermodynamic efficiency and minimizing the amount of energy needed to produce a high-value feedstock for the refinery.

In summary, this invention is directed to a process for improving the flow properties of a crude stream, including processing a first crude stream which may include cracking the first crude stream with fresh catalyst to form a cracked stream and spent catalyst. The cracked stream may be separated from the spent catalyst. The spent catalyst may be regenerated to form fresh catalyst, which may then be recycled. At least part of the cracked stream may be mixed with a second crude stream. The first crude stream may be stripped before being cracked. A ratio of the second crude stream to the first crude stream may be between about 0.5:1 and about 9:1. A ratio of part of the cracked stream to add to the second crude stream may be selected to achieve a API gravity of at least about 18. The first crude stream may be stripped prior to the cracking step.

The cracked stream may be separated into a bottoms stream, light cycle oil, and naphtha, wherein the bottoms stream and the light cycle oil may be combined with second crude stream. The naphtha may be debutanized to form liquefied petroleum gas and gasoline, and the liquefied petroleum gas and the gasoline may be added to the second crude stream. The bottoms stream, light cycle oil, liquefied petroleum gas and gasoline may each have a portion to be mixed with the second crude stream, and each portion may be selected to achieve an API gravity of at least about 18.

The regenerating step may form a regeneration flue gas which may be burned to generate steam. The steam may be superheated. The regenerating step partially burns said regenerated catalyst to form regeneration flue gas having a $CO/CO_2$ ratio of between about 0.6:1 and about 1:1.

The first crude stream may contain bitumen, and the processing step may include deasphalting the bitumen with solvent prior to the cracking step. The deasphalting step may form pitch which may be burned to generate steam.

A process for improving flow properties of crude, may comprise heating and stripping a first crude stream, cracking the first crude stream with fresh catalyst to form vaporized cracked stream and spent catalyst. The vaporized cracked stream may be separated from the spent catalyst, and the spent catalyst may be regenerated to form fresh catalyst, to be recycled. The vaporized cracked stream may be condensed to obtain a condensed stream, and at least part of the condensed stream mixed with a second crude stream.

The process may also comprise heating a first crude stream. Then the first crude stream may be stripped. Then the first crude stream is cracked with fresh catalyst to form cracked stream and spent catalyst. The cracked stream is separated from the spent catalyst, which is regenerated to form fresh catalyst to be recycled. The cracked stream may be fractionated into light ends, naphtha, light cycle oil, and bottoms. At least part of the naphtha and the light cycle oil may be mixed with a second crude stream.

The apparatus for improving the flow properties may comprise: riser 40 charged with fresh catalyst and having a bottom and a top, wherein a crude conduit delivers a first crude stream into the bottom and an outlet withdraws spent catalyst and vaporized cracked stream from the top. A vessel may be in flowable communication with the outlet and containing a cyclone for receiving and separating the vaporized cracked stream from the spent catalyst. Regenerator 70 may be in flowable communication with the vessel for receiving and regenerating the spent catalyst to form the fresh catalyst. A standpipe may be connected between the riser and the regenerator for recharging the riser with the fresh catalyst. Fractionator 30 may be in flowable communication with the vessel for receiving vaporized cracked stream and fractionating it into light ends, naphtha, light cycle oil and bottoms, and lines in flowable communication with the fractionator may deliver at least part of the naphtha and the light cycle oil to a second crude stream. The regenerator may have a catalyst cooler for cooling the catalyst. The regenerator may emit flue gas which may be burned in a boiler to form steam. A compressor and a turbine may harness the energy from the steam. The boiler may have a fluidized bed suitable for pitch.

While the foregoing written description of the invention enables one of ordinary skill to make and use what is considered presently to be the best mode thereof, those of ordinary skill will understand and appreciate the existence of variations, combinations, and equivalents of the specific exemplary embodiments thereof. The invention is therefore to be limited not by the exemplary embodiments herein, but by all embodiments within the scope and spirit of the appended claims.

EXAMPLE 1

In this example, crude oil from characterized in Table 1 is divided into a feed stream comprising about 30 wt-% of the crude oil.

TABLE 1

| Sample Crude (from Colombia) | |
|---|---|
| API gravity | 12.8 |
| UOP K | 11.40 |
| Nickel, wt-ppm | 42 |
| Vanadium, wt-ppm | 152 |
| Sulfur, wt-% | 1.28 |
| Con-Carbon, wt-% | 12.88 |

The sample crude feed in Table 1 was subjected to FCC processing to obtain a product with the composition in Table 2. The composition in Table 2 is based on a recovery of 89 wt-% of $C_4$'s and 66 wt-% recovery of $C_3$'s for remixing with the bypass crude.

TABLE 2

| Estimated Conditions for the FCC Unit | |
|---|---|
| | Products |
| Feed Rate, BPSD | 15,000 |
| Riser Temperature, ° F. (° C.) | 450 (232) |
| Reactor Temperature, ° F. (° C.) | 975 (524) |
| Reactor Pressure, psig | 20 |
| Catalyst MAT | 64 |

TABLE 2-continued

| Estimated Conditions for the FCC Unit | Products |
|---|---|
| Catalyst/Oil, lb/lb feed | 10.09 |
| Delta Coke, wt % | 1.50 |
| Regenerator Temperature, ° F. (° C.) | 1228 (664) |
| Conversion, vol-% (90% @ 380° F. (193° C.) | 66.6 |
| Liquid Recovery, vol-% | 99.12 |
| Mix API | 39.7 ** |
| Mix RVP @ 100° F. (38° C.) | 28.9 ** |

The FCC product of Table 2 was mixed with the unprocessed crude characterized in Table 1 to obtain in a proportion of 70% crude to 30% FCC product diluent by weight to obtain a blend with the properties in Table 3.

TABLE 3

FCC Product Diluent Mixed with Unprocessed Crude

| | Unprocessed Crude | FCC Liquid Product | Blend |
|---|---|---|---|
| BPSD | 70,000 | 28,413 | 98,413 |
| Lb/hr | 1,001,465 | 341,739 | 1,343,204 |
| API | 12.3 | 39.7 | 19.6 |
| Reid Vapor Pressure @ 100° F., psia | | 28.9 | 14.8 |
| Viscosity, cSt @ 100° F. | 28,000 | 1.1 | 24.9 |
| Viscosity cSt @ 212° F. | 47 | 0.4 | 5.4 |

The blended product has API gravity and viscosity properties that meet most pipeline specifications.

EXAMPLE 2

In this example, the feed to the process is bitumen having API gravity of 10.2. All of the bitumen is subjected to a solvent-deasphalting step. The pitch created from the deasphalting step may then be burned in a CO boiler. For purposes of comparison, the pipeline specification will be assumed to require a specific gravity of at least 19 API and a viscosity of no more than 120 cSt at 77° F. (25° C.). Table 4 gives properties for the product of FCC processing of bitumen.

TABLE 4

FCC Products for Bitumen-containing Crude Feed

| | Wt-% | API | LV-% |
|---|---|---|---|
| C5+ naphtha 380° F./90% (193° C./90%) | 44.72 | 52.68 | 56.18 |
| LCO (600 F. °/90%) | 17.24 | 14.73 | 17.19 |
| Bottoms at 650° F. (343° C.) | 14.13 | 2.71 | 12.93 |
| C3 + C4 | 11.54 | | |
| Total | 87.63 | | |

Table 5 shows properties of the components of the diluent and the whole bitumen.

TABLE 5

FCC Products for Bitumen-containing Crude Feed

| | UOP K | Viscosity cSt @ 122° F. (50° C.) | Viscosity cSt @ 210° F. (99° C.) | Viscosity cSt @ 77° F. (25° C.) | R Refutas VBN @ 77° F. (25° C.) | Fraction of Diluent, wt-% | Specific Gravity, g/cc |
|---|---|---|---|---|---|---|---|
| Whole bitumen | | 6000 | 150 | 105,520 | 46.559 | | |
| $C_5$+ naphtha | 11.52 | 0.538 | 0.381 | 0.703 | −2.075 | 58.778 | 0.768 |
| LCO | 10.3 | 3.093 | 1.341 | 5.915 | 20.338 | 22.655 | 0.968 |
| Bottoms | 10.23 | 91.03 | 8.881 | 555.3 | 37.776 | 18.567 | 1.054 |
| Diluent Mixture | | | | 1.8 | 10.40 | 100.000 | 0.851 |

The API gravity of the diluent mixture is in Table 6, the properties of blends of diluent and bitumen are given at different proportions.

TABLE 6

Blending Properties of Deasphalted Bitumen and Combined $C_5$+ FCC Product

| Diluent, wt-% | Bitumen, wt-% | Specific Gravity, g/cc | API | Refutas VBN @ 77° F. (25° C.) | Viscosity, cSt @ 77° F. (25° C.) |
|---|---|---|---|---|---|
| 0 | 100 | 0.9652 | 15.10 | 44.3 | 19792.9 |
| 5 | 95 | 0.9588 | 16.09 | 42.6 | 6664.13 |
| 10 | 90 | 0.9524 | 17.07 | 40.9 | 2528.947 |
| 15 | 85 | 0.9461 | 18.06 | 39.2 | 1067.391 |
| 20 | 80 | 0.9399 | 19.04 | 37.5 | 495.1267 |
| 25 | 75 | 0.9338 | 20.03 | 35.8 | 249.7246 |
| 30 | 70 | 0.9278 | 21.01 | 34.1 | 135.6311 |
| 35 | 65 | 0.9218 | 22.00 | 32.4 | 78.63587 |
| 40 | 60 | 0.9160 | 22.98 | 30.7 | 48.28679 |
| 19.79 | 80.21 | 0.9402 | 19.00 | 37.6 | 510.2853 |
| 31.08 | 68.92 | 0.9265 | 21.22 | 33.8 | 120 |

Hence, just under 20% of the deasphalted bitumen subjected to FCC processing is sufficient diluent to meet the API gravity specification and just over 31% of the deasphalted bitumen subjected to FCC processing is sufficient diluent to meet the viscosity specification. However, the Table 7 shows that about 45 and 47% of diluent made according to the prior art of coker product mixed with raw bitumen without being subjected to deasphalting is required to meet the same pipeline specifications, respectively.

TABLE 7

| Blend According to Prior Art ($C_5$+ Coker Product) | | | | | |
|---|---|---|---|---|---|
| Diluent, wt-% | Bitumen, wt-% | Specific Gravity, g/cc | API | Refutas VBN @ 77° F. (25° C.) | Viscosity, cSt @ 77° F. (25° C.) |
| 45.42 | 54.58 | 0.9402 | 19.00 | 34.2 | 137.8868 |
| 46.93 | 53.07 | 0.9384 | 19.29 | 33.8 | 120 |

EXAMPLE 3

In this example, 207,670 BPD of Canadian Cold Lake Bitumen having an API gravity of 10.6 is fractionated and the 1050° F.+ vacuum bottoms is fed to a solvent deasphalting process, rejecting a stream of 35,100 BPD of pitch having a gravity of −10 API. 66,460 BPD of the deasphalted oil is sent to an FCC unit and the products boiling below pentane are separated for fuel or sales. The deasphalted bitumen is combined with the blended FCC products to form a synthetic crude oil. The pitch rejected from the process is burned as auxiliary fuel in the CO boiler which generates the required steam for the recovery of bitumen from the ground by the steam-assisted gravity drainage (SAGD) process. The steam/oil weight ratio of the bitumen extraction process is assumed to be 3.0 which is equal to a 20% margin over the reported target value of 2.5 for a commercial process as operated by the EnCana Corporation at their operations in either Christina Lake or Foster Creek, Alberta according to the EnCana Corporate Annual Report, 2002.

TABLE 8

| Pitch Production and Combustion | |
|---|---|
| Heat of Combustion of Cold Lake | 16,659.12 |
| Asphaltenes, Btu/lb (J/g) | (37,790) |
| Total bitumen processed, BPD | 207,670 |
| Total bitumen processed, lb/hr (kg/hr) | 3,027,600 (1,373,296) |
| Pitch make, BPD | 35,100 |
| Pitch make, wt-% | 19.7% |
| Fuel value, MMBTU/D | 23,8458.5 |
| Fuel value, MMBtu/bbl Bitumen | 1.14823 |
| Steam Required to Extract Bitumen, lb/hr (kg/hr) | 9,082,800 (4,119,888) |
| Energy Required to Make Steam, Btu/lb Steam | 1018 |
| Energy Required to Make Steam for Bitumen Extraction, MMBtu/Day | 221,910 |
| % of Steam Generation Energy Requirement Satisfied by Pitch Combustion | 93 |

Table 8 shows that 93% of the energy requirements for extracting bitumen for pipeline transport according to the present invention are provided by low value pitch combusted in a CO boiler.

EXAMPLE 4

In this example, the volume percentage of FCC liquid product required to be added to crude oil to obtain a pour point of the blend below 20° C. was determined. The calculation assumed that FCC gasoline and LCO have the same impact on blending as kerosene. In Table 9, each stream has a reference number corresponding to the line in FIG. 1.

TABLE 9

| Pour Point of Blended Stream | | | | | | |
|---|---|---|---|---|---|---|
| | Crude Oil (3) | Crude Oil to Blending (499) | Crude Oil to Process (5) | FCC Feed (32) | C5+ Products from 30 (500) | C5+ Blend (502) |
| Volume % of Crude | 100.0 | 73.7 | 26.3 | 21.2 | 23.1 | 96.8 |
| Weight % of Crude | 100.0 | 73.7 | 26.3 | 21.8 | 21.4 | 95.1 |
| Specific Gravity, g/cc | 0.8924 | 0.8924 | 0.8924 | 0.9200 | 0.8249 | 0.8763 |
| API | 27.06 | 27.06 | 27.06 | 22.3 | 40.0 | 30.0 |
| Pour Point,° C. | 45 | 45 | 45 | 46 | — | 18 |
| Viscosity @ 100° F., cSt | 104.0 | 104.0 | 104.0 | 365.5 | 4.0 | 38.2 |

Only 26 LV % of the crude stream was required to undergo processing to provide sufficient dilution of the remaining crude stream to obtain a pour point of 18° C.

What is claimed is:

1. A process for improving flow properties of crude, comprising:

processing a first crude stream including directing said first crude stream to a feed zone of a fractionator column, directing fractionator product to a riser, cracking said fractionator product of said first crude stream with fresh catalyst to form a cracked stream and spent catalyst at an oil field;

separating said cracked stream from said spent catalyst;

regenerating said spent catalyst to form said fresh catalyst and regeneration flue gas;

recycling said fresh catalyst;

directing said cracked stream to a product zone of said fractionator column, and said feed zone and said product zone are separated by a partition positioned to isolate the feed zone from the product zone;

mixing at least part of said cracked stream with a second crude stream; and transporting a mixture of said cracked stream and said second crude stream over 20 miles from said oil field where it was mixed in a pipeline to a refinery for further processing.

2. The process according to claim 1, wherein said first crude stream has at least one property selected from the group consisting of an API gravity of less than 18, a viscosity of greater than 10,000 cSt at 38° C. and a pour point of greater than 20° C.

3. The process according to claim 2, wherein a ratio of said part of said cracked stream to said second crude stream is selected to achieve at least one property selected from the group consisting of an API gravity of at least 18, a viscosity of no more than 10,000 cSt at 38° C. and a pour point of no more than 20° C.

4. The process according to claim 1, wherein said first crude stream comprises bitumen, and wherein said processing step further comprises deasphalting said bitumen with solvent prior to said cracking step.

5. The process according to claim 1, further comprising separating said at least part of cracked stream into bottoms, light cycle oil, and naphtha, and wherein said mixing step may comprise mixing at least part of said light cycle oil with said second crude stream.

6. The process according to claim 5, further comprising debutanizing said naphtha to form liquefied petroleum gas and gasoline.

7. The process according to claim 6, wherein said mixing step may comprise combining said liquefied petroleum gas and said gasoline with said second crude stream.

8. The process according to claim 6, wherein in said mixing step respective proportions of said bottoms, said light cycle oil, said liquefied petroleum gas and said gasoline is selected to achieve an API gravity of at least about 18.

9. The process according to claim 1, wherein said regenerating step forms a regeneration flue gas and said process further comprises burning said regeneration flue gas in a boiler to generate steam.

10. The process according to claim 9, further comprising superheating said steam.

11. The process according to claim 4, wherein said deasphalting step forms pitch and said process further comprises burning said pitch in a boiler to generate steam.

12. The process according to claim 1 wherein said first crude stream is between about 10 LV-% and 40 LV-% of said crude oil stream.

13. The process according to claim 1 wherein the feed zone and the product zone are isolated from each other at the bottom of the fractionator.

14. The process according to claim 1, wherein said processing step further comprises stripping said first crude stream prior to said cracking step.

15. A process for improving flow properties of crude, comprising:

heating a first crude stream;

stripping said first crude stream;

directing said first crude stream to a feed zone of a fractionator column;

directing fractionator product to a riser;

cracking said fractionator product of said first crude stream with fresh catalyst to form cracked stream and spent catalyst at an oil field;

separating said cracked stream from said spent catalyst;

regenerating said spent catalyst to form said fresh catalyst and regeneration flue gas having a $CO/CO_2$ ratio of between about 0.6:1 and 1:1;

recycling said fresh catalyst;

directing said cracked stream to a product zone of said fractionator column, and said feed zone and said product zone are separated by a partition positioned to isolate the feed zone from the product zone;

fractionating said cracked stream into light ends, naphtha, light cycle oil, and bottoms;

mixing at least part of said naphtha and said light cycle oil with a second crude stream; and transporting a mixture of said cracked stream and said second crude stream over 20 miles from said oil field where it was mixed in a pipeline to a refinery for further processing.

* * * * *